US009631253B2

(12) United States Patent
Vieira et al.

(10) Patent No.: US 9,631,253 B2
(45) Date of Patent: Apr. 25, 2017

(54) AGING (WEATHERING) INHIBITION METHOD OF IRON ORE PELLETS DURING STOCKPILING

(71) Applicant: VALE S.A., Centro, Rio de Janeiro (BR)

(72) Inventors: Maria Beatriz Harmendani Vieira, Belo Horizonte (BR); Marcus Eduardo Emrich Botelho, Nova Lima (BR)

(73) Assignee: VALE S.A., Rio de Janeiro (BR)

( * ) Notice: Subject to any disclaimer, the term of this patent is extended or adjusted under 35 U.S.C. 154(b) by 77 days.

(21) Appl. No.: 14/572,698

(22) Filed: Dec. 16, 2014

(65) Prior Publication Data

US 2015/0197825 A1 Jul. 16, 2015

Related U.S. Application Data

(63) Continuation of application No. 14/343,032, filed as application No. PCT/BR2012/000339 on Sep. 4, 2012, now abandoned.

(30) Foreign Application Priority Data

Sep. 5, 2011 (BR) ..... 1104742

(51) Int. Cl.
*C22B 1/16* (2006.01)
*C22B 1/24* (2006.01)

(52) U.S. Cl.
CPC ..... *C22B 1/2406* (2013.01); *C22B 1/16* (2013.01)

(58) Field of Classification Search
CPC ..... C22B 1/16; C22B 1/2406
See application file for complete search history.

(56) References Cited

U.S. PATENT DOCUMENTS 3,258,327 A 6/1966 Smoot
3,751,241 A 8/1973 Sloughfy et al.
4,093,448 A 6/1978 Eliseev et al.
4,728,537 A * 3/1988 Allen ..... C22B 1/2406 148/105

(Continued)

FOREIGN PATENT DOCUMENTS

CA 2764535 A1 * 12/2010 ..... C21B 5/02
GB 1 574 719 A 9/1980

(Continued)

OTHER PUBLICATIONS

INPADOC patent family for US2012180599 A1, published Jul. 2012. The earliest family document includes CA 2764535A1 published Dec. 2010.*

(Continued)

*Primary Examiner* — George Wyszomierski
*Assistant Examiner* — Tima M McGuthry Banks
(74) *Attorney, Agent, or Firm* — Arent Fox LLP

(57) ABSTRACT

The present invention refers to an effective method for minimizing the problems of iron ore pellet degradation by weathering during their stockpiling, i.e., by providing an appropriate method for improving the state of the art with regard to iron ore pellet resistance related just to the hydration process of the slag phase. Thus, in order to minimize hydration in the slag phase, stabilizers are introduced into the mixture used to produce iron ore pellets prior to being heat-treated.

10 Claims, 9 Drawing Sheets

(56) References Cited

U.S. PATENT DOCUMENTS

| | | | | |
|---|---|---|---|---|
| 5,395,441 | A * | 3/1995 | Bogdan | C21B 5/008 106/714 |
| 6,384,126 | B1 | 5/2002 | Pirtle et al. | |
| 2012/0180599 | A1 * | 7/2012 | Gunther | C22B 1/20 75/313 |

FOREIGN PATENT DOCUMENTS

| | | | |
|---|---|---|---|
| JP | 59-133304 | A * | 7/1984 |
| JP | 61-058849 | A * | 3/1989 |

OTHER PUBLICATIONS

International Search Report, International Application No. PCT/BR2012/000339 mailing date Nov. 22, 2012.

* cited by examiner

| Oxide (%) | Pel A | Pel B | Pel C |
|---|---|---|---|
| $SiO_2$ | 41,74 | 46,32 | 40,95 |
| CaO | 38,80 | 31,88 | 32,16 |
| $Fe_2O_3$ | 15,55 | 11,12 | 17,58 |
| $Al_2O_3$ | 3,24 | 3,78 | 4,78 |
| MgO | 0,56 | 3,19 | 1,37 |
| $K_2O$ | nd | 0,25 | 0,24 |
| MnO | nd | 0,16 | 0,71 |
| $P_2O_5$ | nd | 2,61 | 1,73 |
| $Na_2O$ | 0,12 | 0,70 | 0,47 |

1st series of experiments

2nd series of experiments

1st series of experiments

2nd series of experiments

1st series of experiments

2nd series of experiments

AGING (WEATHERING) INHIBITION METHOD OF IRON ORE PELLETS DURING STOCKPILING

CROSS-REFERENCED TO RELATED APPLICATIONS

This application is a Continuation of U.S. patent application Ser. No. 14/343,032, now abandoned, which is a National Stage entry of International Application PCT/BR2012/000339 filed Sep. 4, 2012, which claims priority to Brazilian Application No. P111047742-9, filed Sep. 5, 2011, the disclosures of each of these prior applications being hereby incorporated by reference herein in their entirety.

INVENTION FIELD

This present invention intends to use additives to prevent the loss of iron ore pellet strength during stockpiling.

INVENTION BACKGROUND

It is well-known that iron ore pellets are made through processes in which iron ore is mixed with certain additives to prepare a chemical composition suitable for disk pelletizing or rotating drums. The resulting pellets are then taken to kilns where they are burned to become resistant to handling and suitable for use in reduction reactors. In fact, there are countless advantages of using iron ore pellets as liquid steel, especially as it generates fewer fines during handling and within the reduction reactor, and less slag is produced in relation to other liquid steel components, particularly sinters. However, with regard to fines generation, monitoring the physical quality of some kinds of iron ore pellets has historically shown an increasing loss of physical resistance, from its production until its use, including stacking time, time spent in the yards, and transportation. The degradation of the iron ore pellets' physical quality entails:

- more fines generated when received by the customer;
- loss of pellets' performance in the reduction process;
- risk of contractual non-compliance;
- restriction in pelletizing plants' productivity with a significant loss in revenue.

It is also well known that a major cause of degradation in the iron ore pellets' physical quality is due to weathering, resulting from their interaction with moisture and other environmental agents. For this reason, rain water and the water used to cut down on particulate emission have a strong influence on the aging cycle frequency. However, so far, a truly effective mechanism has not been found that would cut down on the hydration process with subsequent slag phase solubilization during iron ore pellet stockpiling.

BRIEF DESCRIPTION OF THE INVENTION

Therefore, in order to minimize the aforementioned problems, the present invention introduces aging inhibitors into the iron ore pellet production mixture, prior to heat treatment in an oxidizing atmosphere, to reduce hydration in the slag phase.

More specifically, the invention aims to minimize the pellets' degradation problems caused by weathering during stockpiling, i.e., envisioning an appropriate method for improving the state of the art with regard to the pellets' loss of resistance brought about by the slag phase's hydration process while being stockpiled.

Therefore, the present invention comprises a method to protect iron ore pellets during their slag phase aging process, including the phase during which hydration reaction inhibitors for the slag phase of heat-treated iron ore agglomerates are added.

In the preferred embodiment of this present invention's method, inhibitors are added to the pulp before the cold agglomeration process (pelletizing or microagglomeration), and aging inhibitors include metal oxides.

The metal oxides are preferably selected from a group of materials consisting of alumina, kaolinite ($Al_2O_3.2SiO_2.2H_2O$), fine silica, titanium oxides, Mg, and Zn, but they may also be selected from any other metal oxides that reduce the silicate's K, Na, and Ca content.

The metal oxides may be introduced and tested at an increasing rate until a maximum limit has been reached, depending on the product's desired chemical stability. Preferably, this shall be carried out up to a minimum limit to which the slag's composition in the post-burning agglomerate simultaneously meets the conditions of ($CaO+Na_2O+K_2O$)<45% and $$\frac{(SiO_2/60) + (AlO3/102)}{(CaO/56) + (Na2O/62) + (K2O/94)} > 0.6$$

The inhibiting material shall be applied as particulate material <45 μm or preferably 80%<20 μm to ensure the stabilizing elements' greater reactivity and integration in the slag.

Furthermore, the inhibiting materials may be added as powder or diluted in the slurry.

Finally, the invention's method may be applied to other types of iron ore agglomerates whose resistance depends on the type of calcium silicate and iron in the slag phase.

DESCRIPTION OF FIGURES

FIG. 1*a* depicts the hydration effect on the pellet's surface;

FIG. 1*b* depicts the hydration's evolution over time;

DETAILED DESCRIPTION OF INVENTION

The following detailed description is not intended in any way to limit the invention's scope, applicability, or configuration. More precisely, the following description provides arrangements for implementing the exemplary modalities. By using the instructions provided herein, those who are skilled in the art will recognize suitable alternatives that can be used without going beyond the invention's scope.

Iron ore degradation due to weathering during stockpiling and transportation is a serious problem faced by a number of iron ore producing companies. Therefore, the present invention aims to advance the state of the art by proposing solutions that have not yet been achieved in relation to iron ore pellet aging, specifically with regard to the slag phase, in which moisture from ambient humidity or rain presents a great challenge due to the severe loss of iron ore pellet resistance.

The initial investigations focused on understanding the aging mechanism in the slag phase. Toward this end, industrial pellets collected in the layer over the grid, both top and bottom, were investigated. These pellets were cut and submerged in deionized distilled water at room temperature for 60 days. Pellets with etching in smaller time intervals were also looked at to evaluate the phenomenon's evolution. From there, the effects of moisture on the pellets' surface, hydration evolution over time, and the hydration reaction residue of the hydration were examined.

Figure 1A:
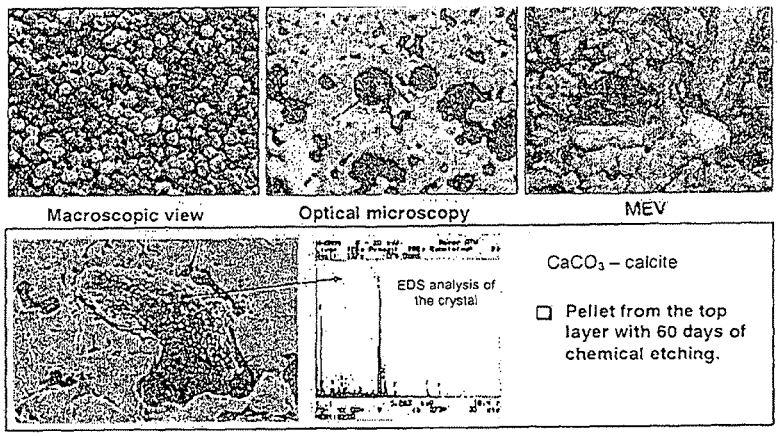
FIGS. 1*a* and 1*b* depict the results of the microstructural analysis of the iron ore pellets that were submitted to hydration in water under the present invention.
Figure 1B:
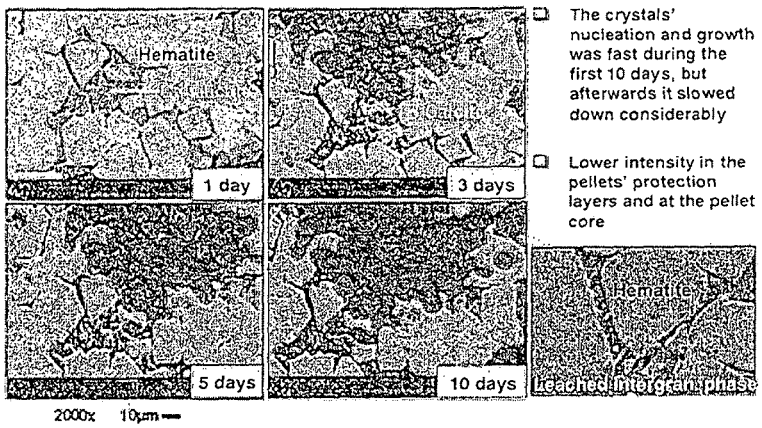

The results of this analysis are summarized in Table 01 below as regards the characterization of the hydration reaction residue and in FIGS. 1*a* to 1*b*:

TABLE 01

| XPS (%) Analyzing the residue obtained by immersing the pellet in water and water evaporation | | | | | | EAIP (mg/l) Analyzing the aqueous solution in which the pellet was immersed. There were no precipitating compounds. | | | | | |
|---|---|---|---|---|---|---|---|---|---|---|---|
| C | 21.68 | Ca | 1.81 | Mg | — | C | — | Ca | 24.50 | Mg | 0.138 |
| O | 55.50 | Cl | — | Fe | — | O | — | Cl | 1.16 | Fe | <0.013 |
| Si | 19.18 | K | 1.82 | Al | — | Si | 90.70 | K | 1.15 | Al | <0.035 |

The aqueous solution: Si (90.70 mg/l), Ca (24.50 mg/l), Cl (1.16 mg/l), K (1.15 mg/l), and Mg (0.138 mg/l). The Fe and Al appear in insignificant amounts in terms of concentration.
The compounds formed by the evaporation of the aqueous solution: $SiO_2$, $CaCO_3$, $Na_2CO_3$, $Si_xCa_yO_z$, and $Si_xCa_yO_z H_w$.
** Photoelectron Spectroscopy Excited by X-ray (XPS) determines the atomic compounds in nano-materials
Inductively coupled plasma atomic emission spectroscopy (ICP-AES) (EAIP)

And the results show that:

The product from the hydration process was a compound based on Si and Ca (torbemorite) without the presence of Fe ions, indicating the assumption that it was caused by the calcium silicate hydration and not the Ca ferrites.

Based on the reaction below, calcite crystals are formed by the reaction of calcium hydroxide generated in this reaction with the $CO_2$:

$$3[2(CaO.SiO_2)]+3.5H_2O \rightarrow 5CaO.2SiO_2.2.5H_2O+Ca(OH)_2$$

$$Ca(OH)_2+CO_2 \rightarrow CaCO_3+H_2O$$

The partial leaching of calcium silicate increased the pellet's intergranular porosity, thus enhancing the progress of its physical weakening or loss of mechanical strength.

The growth and nucleation of calcium carbonate crystals were more pronounced in the first 10 days of contact with moisture.

Once the mechanisms involved in dissolution of the slag were detected, i.e., that aging is caused by decomposition or partial leaching from the glass binder phase, including all varieties of calcium silicates, when exposed to ambient moisture or rain, the factors that influence these mechanisms were then investigated.

Figure 2:
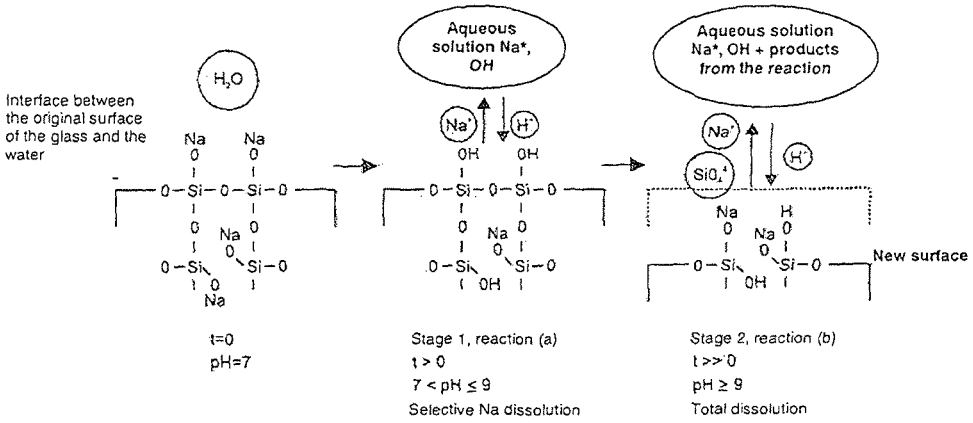
FIG. 2 depicts the corrosion mechanisms of soda glass in water.

Academic publications produced in recent decades pertinent to the glass industry suggest that the corrosion mechanisms of soda-lime glass by water take place according to the schematic drawing in FIG. 2. In the first stage—reaction (a)—there is an exchange between sodium (Na+) and potassium (K+) ions of the glass and hydrogen ions in the solution, and in the second stage—reaction (b)—the main connections (Si—O—Si) break down, causing the glass structure to dissolve.

Figure 3:
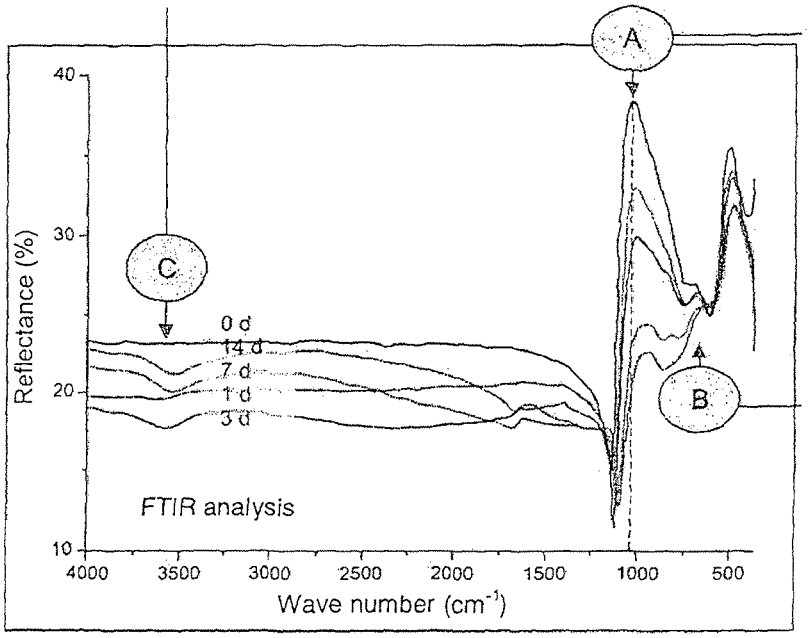
FIG. 3 depicts the steps in the chemical etching process involving the leaching and dissolution of the synthetic slag network in a type of iron ore pellet.

FIG. 3 shows the evolution of the leaching of a synthetic silicate, with a composition similar to a type of iron ore pellet. In FIG. 3, there is:

a peak highlighted as A, which indicates the S-peak, i.e., the O—Si—O—Si—O binding as regards the increase in surface roughness indicating chemical etching of the glass surface without the formation of a protective layer (network dissolution);

a peak highlighted as B relative to the NS-peak, i.e., indicating an increase in the modifying cation content on the glass surface, which may be related to the deposition of salts, such as $Na_2CO_3$ and $CaCO_3$, arising from severe corrosion;

a peak highlighted as C related to the hydration band, i.e., indicating the presence of water in the glass structure since the first day and well-developed on the third day.

Note that this glass tends to be continuously dissolved by the presence of an aqueous solution, given that the formation of an $SiO_2$-rich layer was not found, which is a protective mechanism against corrosion.

Figure 4A:
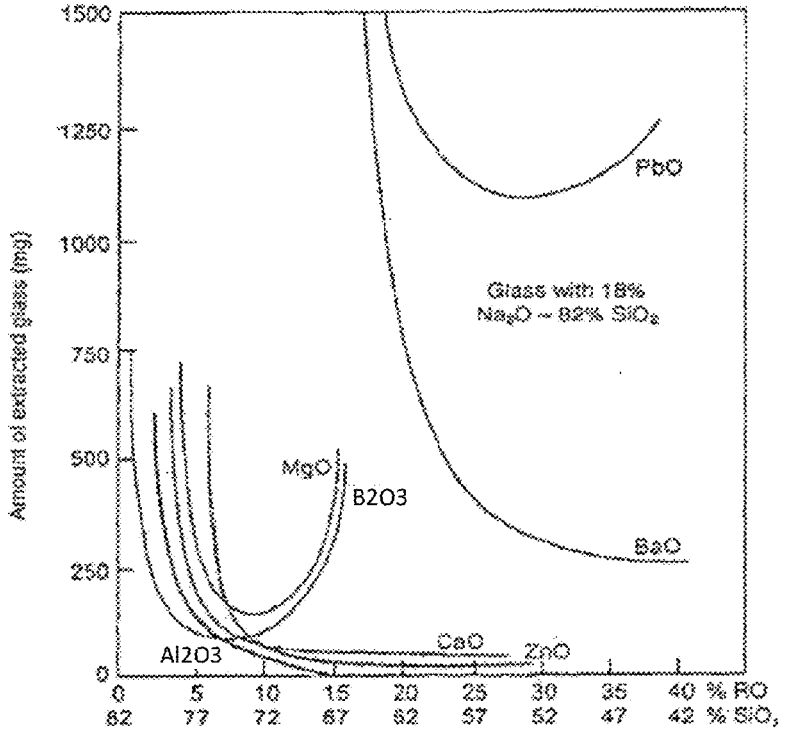
FIGS. 4*a* and 4*b* depict the effect of the incorporations and oxides on the corrosion of soda-lime glass in water.
Figure 4B:
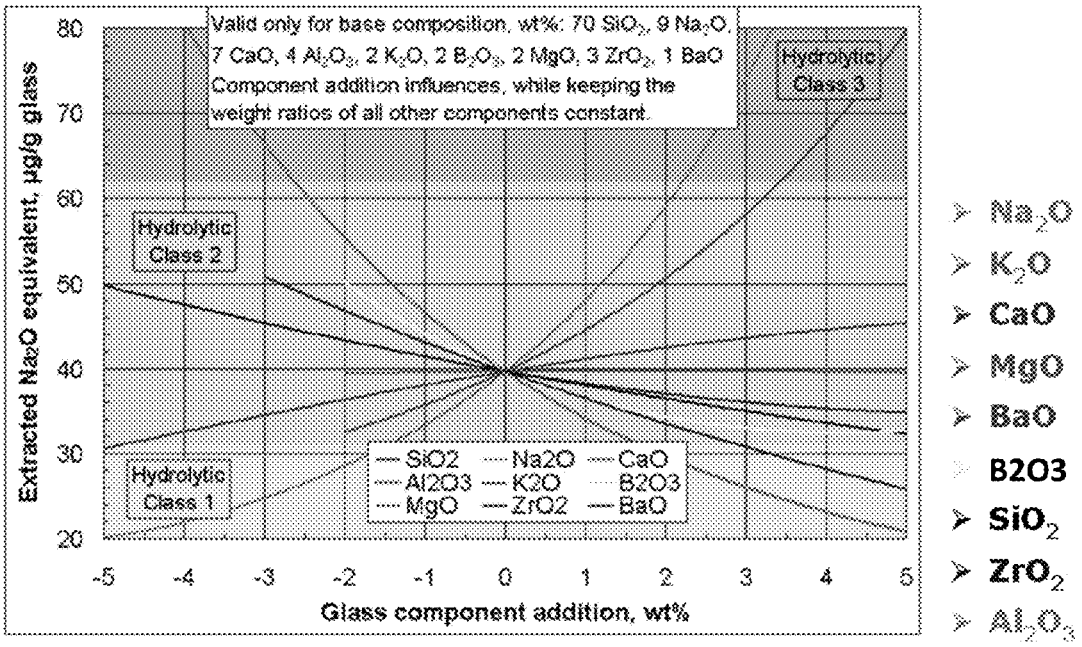

In the case of soda-lime glass, the incorporation of the alkaline earth oxides or other divalent or trivalent oxides to the glass considerably increases the chemical resistance to water, according to FIGS. 4*a* and 4*b*.

Figure 5:
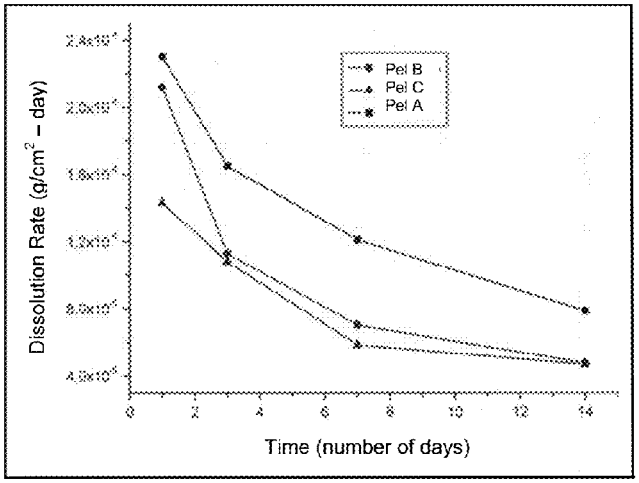
FIG. 5 depicts the effect of the chemical composition of the synthetic slag phase of some types of iron ore pellets on the dissolution process.

The same evolution profile can be seen in the aging test for iron ore pellets. In this test, the effect of the synthetic slag phase iron ore pellet composition on the hydration process, or aging, was also evident, as shown in FIG. 5. From the results, it can be seen that:

The type C pellet slag was more resistant to dissolution since the first day.

The dissolution of the glass from the B type pellet showed an initial behavior similar to the C type, with the possible development of a protective layer on subsequent days, approaching the behavior of C type pellet.

Figure 6:
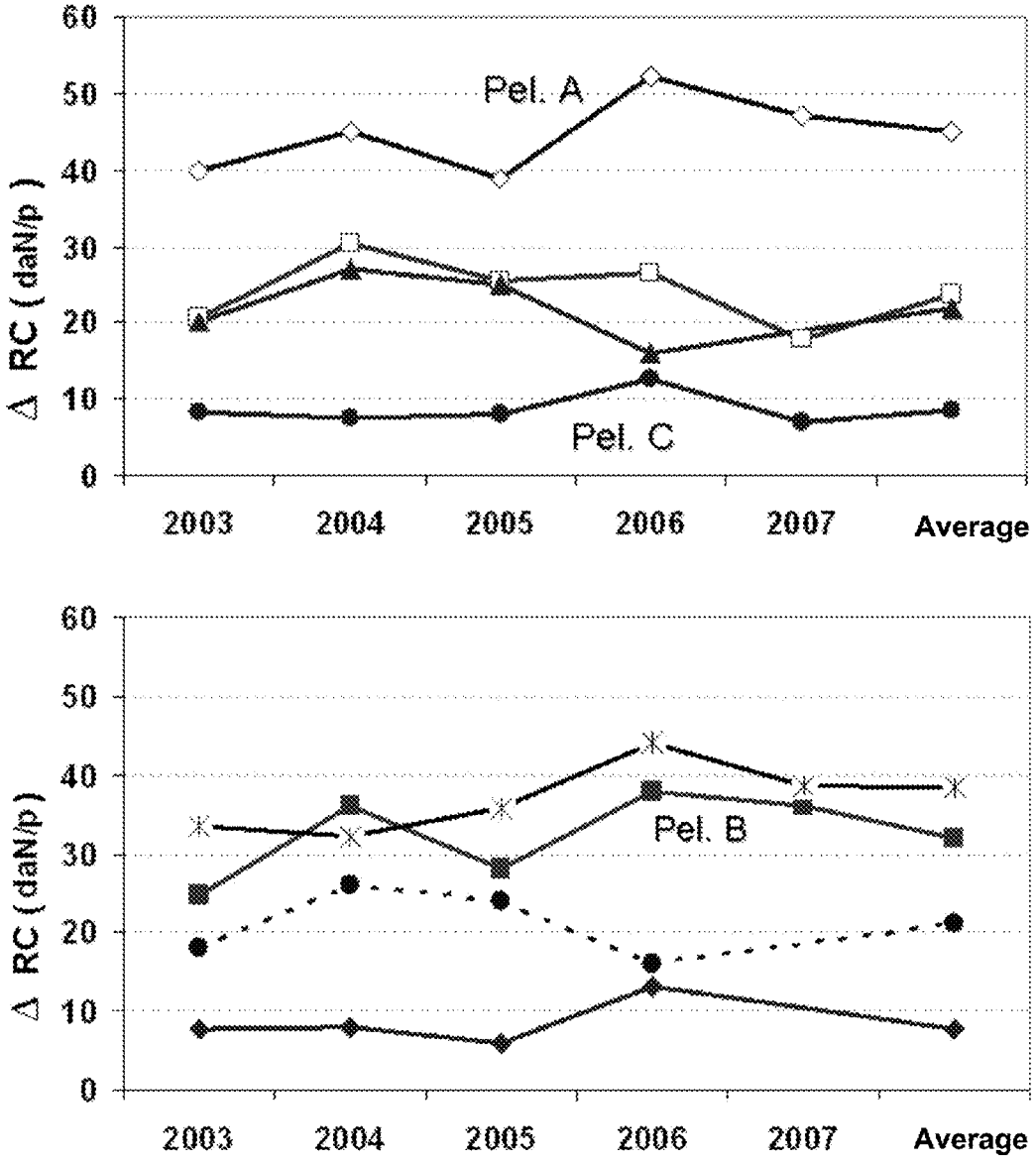
FIG. 6 depicts the variation of compression strength in some types of industrially produced iron ore pellets.

These results are consistent with industry practice, as shown in FIG. 6, and strongly correspond with the pellets' relative loss of strength, confirming the strong influence of the slag's composition on the degradation phenomenon through aging.

Accordingly, the aim of the present invention is to act in the slag phase in order to minimize hydration that takes place during iron ore pellet stockpiling. In other words, the main objective of the present invention is to provide an efficient method for stabilizing the composition in the pellets' slag phase, thereby minimizing the hydration reactions and stabilizing them in the weathering processes, thus inhibiting the pellets' aging and loss of physical resistance.

Therefore, in order to minimize hydration in the iron ore pellets' slag phase, a process was developed involving the addition of stabilizing compounds to the mixture prior to its heat treatment. More specifically, the aging inhibitors are introduced into the slag phase composition. More specifically still, the aging inhibitors consist essentially of metallic oxides that have been selected according to the recommendations found in FIGS. 4*a* and 4*b*, in particular Ba, B, Si, Zr, Al, and Zn. More preferably, the ones that have minimal impact on the quality required for the use of iron ore pellets in reduction reactors are recommended, such as Al and Si. Theoretically, there are no limits on the amount of these additives since they enter the silicate composition as modifying elements. In the literature, there are glasses with up to 18% $Al_2O_3$. Thus, the maximum amount to be dosed to inhibit aging in the slag phase is limited by the pellet's desired chemical quality. In other words, the amounts of these oxides should be as small as possible, so as not to result in significant changes in the pellets' chemical compositions. The result will largely depend on the metal oxide content in the indicated source of such materials and the assimilation kinetics of these oxides in the slag phase, and also mainly on the granulometric distribution of the materials used as the source of these oxides to ensure their reactivity and integration in the slag. Ideally, these source materials should be 100% below 10 μm to minimize the amount of material to be used. But nothing prevents the size from being greater than that, depending on other characteristics that could influence the reactivity, such as porosity, grain size, and others, and the iron ore pellets' specifications with regard to the added elements.

Figure 7:
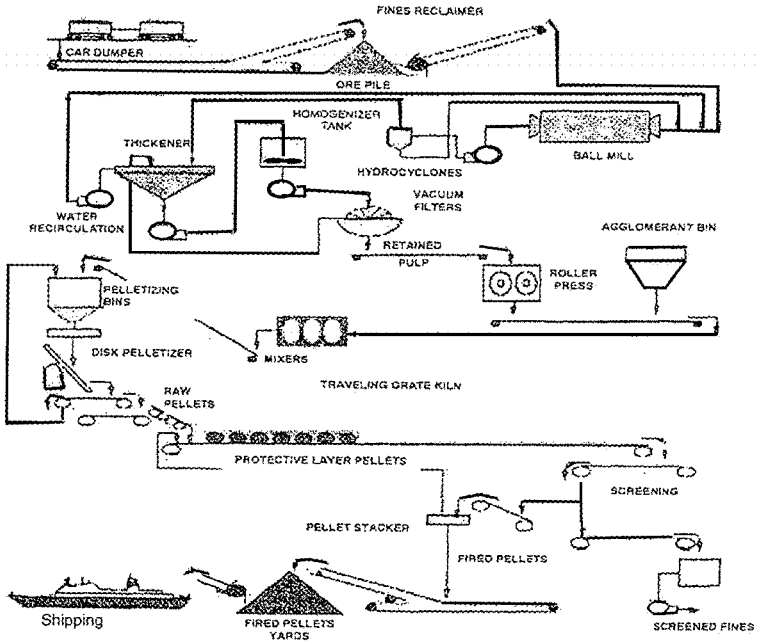
FIG. 7 depicts the pelletization process flowchart.

The source materials for the age inhibiting metal oxides can be added to the iron ore mixture in any form, for instance, in an aqueous solution or as dry material (powder). The dosage should be carried out using the customary equipment for these applications. Given that ultrafine particulate material can be partially removed from the pulp during the thickening and filtration stages, it is recommended that the dose be added between the filtration and the pelletizing stages (FIG. 7). It should be noted that, due to the small amount of the additive relative to the ore mass, it is important that the homogenization stage ensures its thorough distribution in the mixture to assure the least possible deviation in the aging inhibition effect.

The proposed solution was tested on a pilot scale and the results confirmed those from the bench scale. In these tests, the performance of four kinds of materials was evaluated, three (3) rich in Si and Al oxides and 1 (μm) rich in silicon as shown in Table 02 below, in two sets of experiments. Table 02 shows the chemical composition of the sources of the age inhibiting metal oxides produced on a pilot scale:

| | SHA1 | SHA2 | SHA3 | SHA4 | SI1 |
|---|---|---|---|---|---|
| $Fe_2O_3$ | 2.14 | 1.27 | 1.32 | — | 1.36 |
| $SiO_2$ | 45.6 | 45.3 | 46.1 | 43.93 | 92.3 |
| $Al_2O3$ | 36.3 | 36.9 | 37.4 | 36.63 | 0.55 |
| CaO | 0.057 | 0.057 | 0.057 | 0.020 | 1.12 |

-continued

| | SHA1 | SHA2 | SHA3 | SHA4 | SI1 |
|---|---|---|---|---|---|
| MgO | 0.017 | 0.017 | 0.020 | 0.040 | 0.26 |
| $P_2O_6$ | 0.199 | 0.3 | 0.32 | — | 0.22 |
| $TiO_2$ | 2.32 | 1.69 | 1.95 | — | — |
| MnO | — | — | — | — | — |
| $Na_2O$ | 0.054 | 0.180 | 0.161 | — | — |
| $K_2O$ | 0.041 | 0.041 | 0.041 | — | — |
| PF | 13.8 | 14.3 | 14.1 | 13.17 | — |

Figure 8:
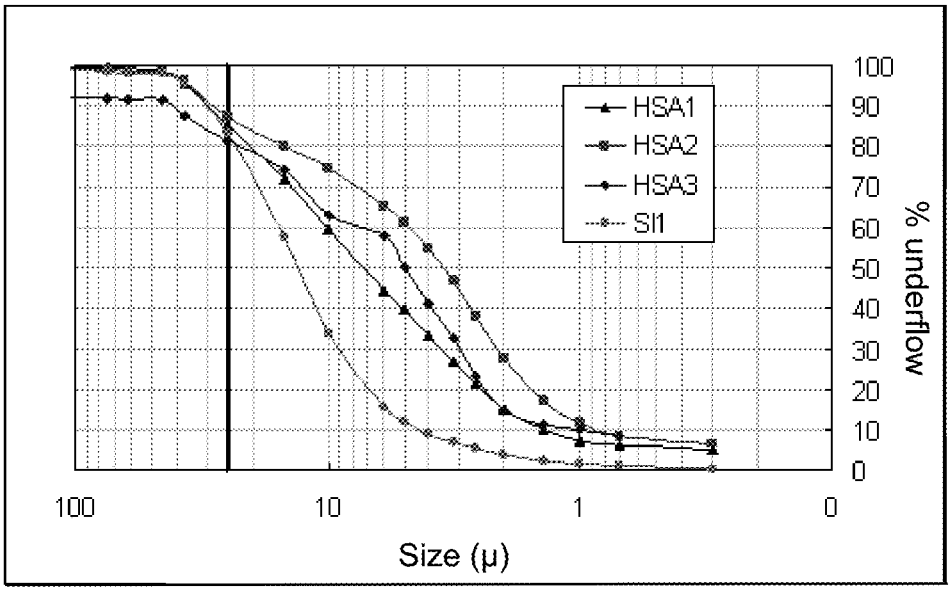
FIG. 8 depicts the granulometric distribution of the oxide source materials that inhibit aging in the iron ore pellets produced on a pilot scale.
Figure 8:
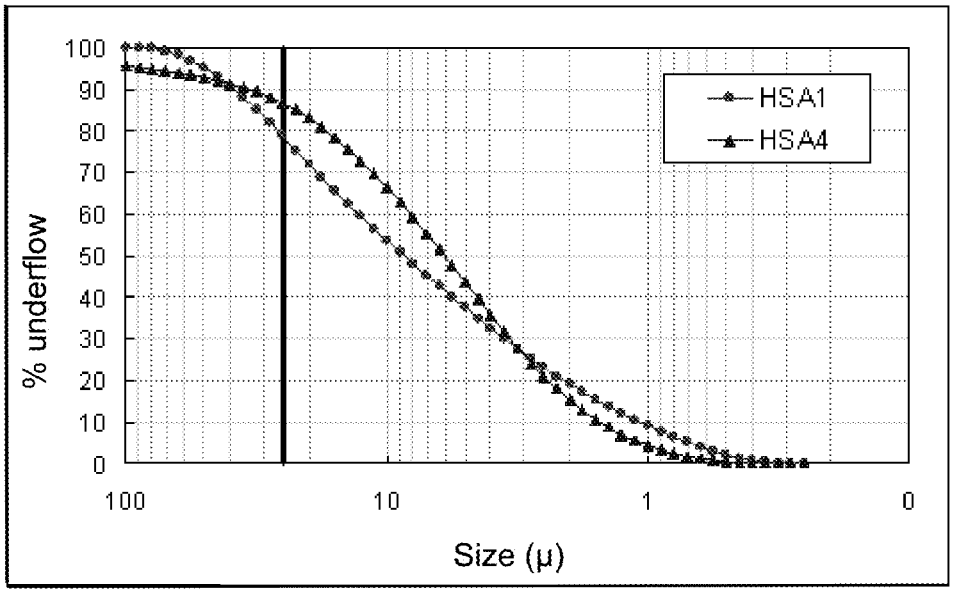
Figure 9:
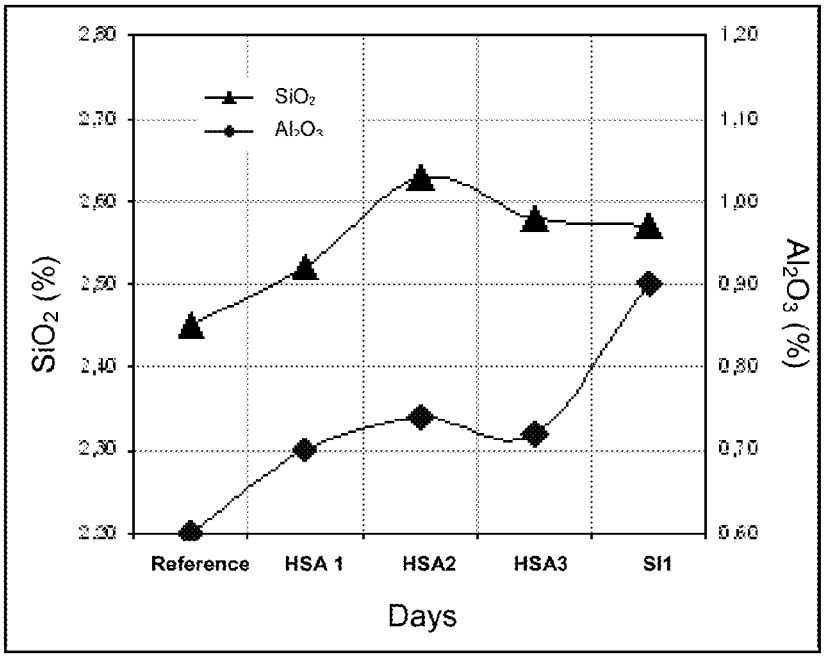
FIG. 9 depicts the incorporation of metal oxides by means of the materials added to inhibit the hydration process in iron ore pellets produced on a pilot scale.
Figure 9:
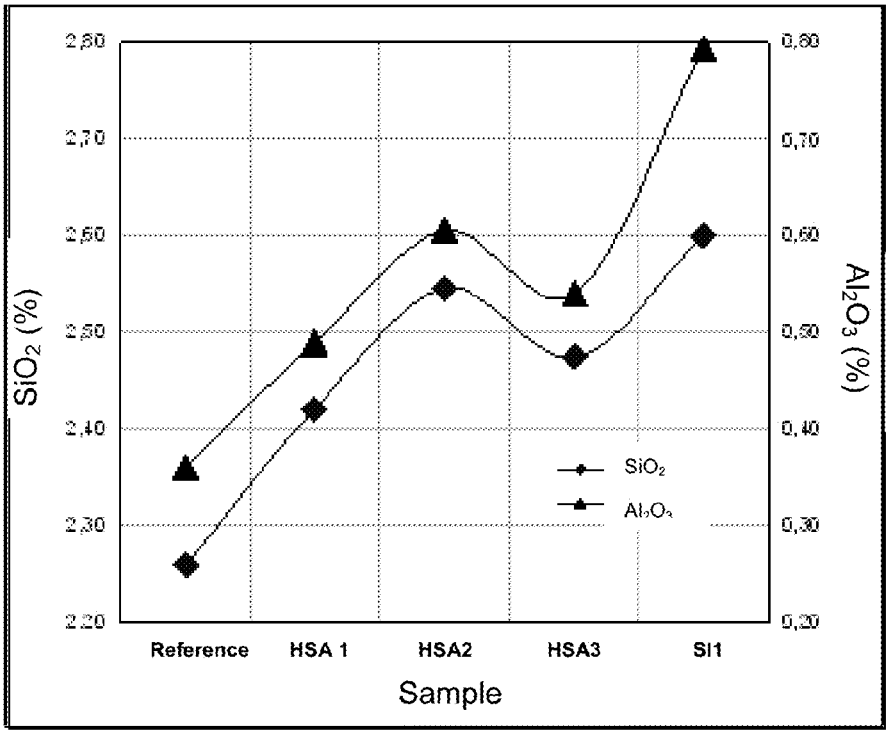
Figure 10:
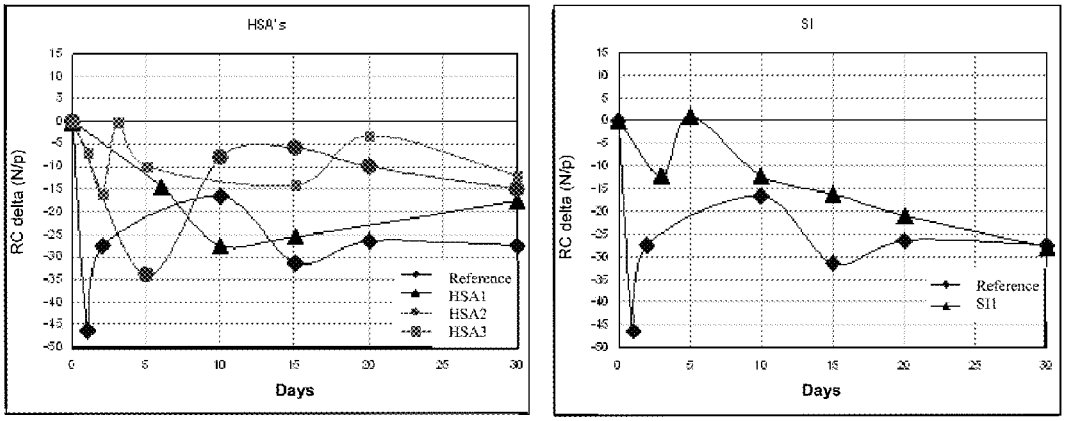
FIG. 10 depicts variations in the compression strength of fired iron ore pellets produced with and without addition of inhibiting metal oxides in the hydration process.
Figure 10:
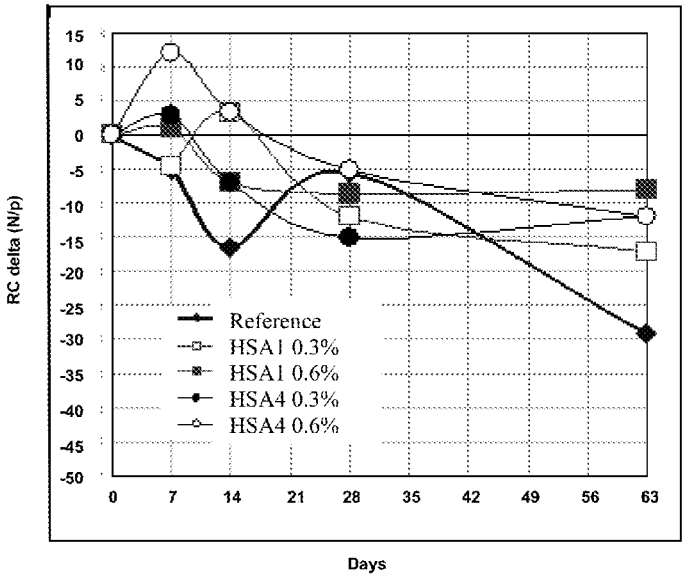

The granulometric distribution of these materials is shown in FIG. 8. FIG. 9 shows the metal oxide incorporations by means of the materials added to inhibit the hydration process. FIG. 10 shows the variation in resistance for fired pellets after stockpiling, with and without adding the inhibitors' source materials. It can be concluded from these results that the use of hydrated aluminum silicate (SHA) in a dosage from 0.3% to 0.7% proved to be effective in inhibiting the iron ore pellet aging process and the use of these inhibitors had the negative effect of increasing the amounts of $SiO_2$ and $Al_2O_3$ in the fired pellet in the order from 0.10% to 0.3% at the used dosages.

In the above detailed description, the invention was described with reference to specific procedures. However, it is apparent that a number of modifications and changes may be made without departing from the invention's scope as set forth in the above claims.

While different types of equipment, systems, and methods for confirming the use of an oral device have been described, it will be apparent to a skilled technician that many other methods and implementations are possible within the scope of the accompanying claims. Therefore, the apparatus, systems and methods to confirm the oral use of a device should not be restricted to the appended claims and their equivalents.

The invention claimed is:

1. A method for producing iron ore pellets resistant to degradation during a slag phase aging process, comprising:

mixing iron ore pulp with aging inhibitors and forming iron ore pellets; and heat-treating the iron ore pellets;

wherein the heat-treated iron ore pellets are resistant to degradation during the slag phase aging process;

wherein the mixing comprises adding the aging inhibitors to the iron ore pulp during the slag phase aging process as a particulate material <45 μm; and wherein the heat-treated iron ore pellets meet the following conditions:

$$(CaO+Na_2O+K_2O)<45\% \text{ and}$$

$$\frac{(SiO_2/60)+(AlO3/102)}{(CaO/56)+(Na2O/62)+(K2O/94)} > 0.6.$$

2. The method of claim 1, wherein mixing and forming further comprises:

performing a cold agglomeration process to pelletize the mixed iron ore pulp and aging inhibitors or to form microagglomerates of the mixed iron ore pulp and aging inhibitors.

3. The method of claim 1, wherein the aging inhibitors include metal oxides.

4. The method of claim 3, wherein the metal oxides are selected from the group consisting of aluminum, kaolinite ($Al_2O_3$, $2SiO_2$, $2SH_2O$), fine silica, titanium oxides, Mg, and Zn.

5. The method of claim 3 wherein the metal oxides reduce K, Na, and Ca content of silicates.

6. The method of claim 3, comprising:

adding the metal oxides to the iron ore pulp and testing at an increasing rate until a maximum limit has been reached, depending on a desired chemical stability of the heat-treated iron ore pellets.

7. The method of claim 1, wherein the heat-treated iron ore pellets have a commercial grade chemical quality.

8. The method of claim 1, wherein the heat-treated iron ore pellets are resistant to degradation depending on a type of calcium silicate and iron in the heat-treated iron ore pellets during the slag phase aging process.

9. The method of claim 1, wherein 80% of the particulate material is <20 μm.

10. A method for producing iron ore pellets resistant to degradation during a slag phase aging process, comprising:

mixing iron ore pulp with aging inhibitors and forming iron ore pellets; and heat-treating the iron ore pellets;

wherein the heat-treated iron ore pellets are resistant to degradation during the slag phase aging process;

wherein the mixing comprises adding the aging inhibitors to the iron ore pulp as a particulate material <45 μm; and wherein the heat-treated iron ore pellets meet the following conditions:

$$(CaO+Na_2O+K_2O)<45\% \text{ and}$$

$$\frac{(SiO_2/60)+(Al2O3/102)}{(CaO/56)+(Na2O/62)+(K2O/94)} > 0.6.$$

* * * * *